US005727707A

United States Patent [19]

Wickland et al.

[11] Patent Number: 5,727,707

[45] Date of Patent: Mar. 17, 1998

[54] HEPA FILTERED STORAGE CANISTERS

[75] Inventors: Terry J. Wickland, Golden; Carl Stephens, Arvada, both of Colo.

[73] Assignee: Nuclear Filter Technology, Inc., Golden, Colo.

[21] Appl. No.: 707,493

[22] Filed: Sep. 25, 1996

[51] Int. Cl.[6] ..... B65D 51/20

[52] U.S. Cl. ..... 220/288; 220/303; 220/371; 220/641; 220/654

[58] Field of Search ..... 220/371, 288, 220/303, 304, 643, 641, 646, 654

[56] References Cited

U.S. PATENT DOCUMENTS

| | | | |
|---|---|---|---|
| 3,977,560 | 8/1976 | Stumpf et al. | 220/371 |
| 4,136,796 | 1/1979 | Dubois et al. | 220/371 |
| 4,500,328 | 2/1985 | Brassell et al. . | |
| 4,696,409 | 9/1987 | Vizz | 220/303 |
| 4,756,852 | 7/1988 | Temus . | |
| 4,957,522 | 9/1990 | Brassell . | |
| 5,042,679 | 8/1991 | Crowson et al. . | |
| 5,111,955 | 5/1992 | Baker et al. | 220/303 |
| 5,193,709 | 3/1993 | Brassell . | |
| 5,353,949 | 10/1994 | Seibert et al. . | |
| 5,395,006 | 3/1995 | Verma | 220/371 |
| 5,649,639 | 7/1997 | Dolvet et al. | 220/371 |

*Primary Examiner*—Joseph M. Moy
*Attorney, Agent, or Firm*—Millen, White, Zelane, & Branigan, P.C.

[57] ABSTRACT

Plutonium powders are stored in stainless steel canisters with stainless steel lids. The stainless steel canisters are extruded and have no interior welds. Each canister includes a vent with an integral HEPA filter. The canisters are of various capacities and nest, one within another, when not used for storage.

20 Claims, 4 Drawing Sheets

HEPA FILTERED STORAGE CANISTERS

FIELD OF THE INVENTION

The present invention relates to HEPA filtered storage canisters. More particularly, the present invention relates to HEPA filtered storage canisters, especially useful for storing radioactive materials, such as plutonium, in the form of oxides and salts, as well as in other.: forms.

BACKGROUND OF THE INVENTION

Plutonium is a man-made radioactive element which is used as an explosive ingredient in nuclear weapons and as a fuel for nuclear reactors. It has the important nuclear property of being readily fissionable with neutrons and is available in relatively large quantities. Caution must be exercised in handling plutonium to avoid unintentional formation of critical mass. Plutonium in liquid solutions is more apt to become critical than solid plutonium, so it is also very important to avoid the unintentional creation of a liquid solution. Since plutonium is considered to be highly carcinogenic, it is important that plutonium in any form be contained and not escape into the surrounding environment where it can be inhaled or otherwise ingested by humans or other living things. Frequently, plutonium oxides and salts are in the form of powders which require very special handling to ensure that particles do not become suspended in the air and that liquid does not come into contact with the powders. It is also very important that, if fluid occurs in or develops in the powders, that containers holding the powders are vented.

SUMMARY OF THE INVENTION

In view of the aforementioned considerations, it is a feature of the present invention to provide new and improved canisters for storage of hazardous materials such as radioactive materials.

In view of these features and other features, the present invention is directed to a canister for containing hazardous material. The canister comprises a seamless canister body having a mouth defined by a rolled edge with a depending annular lip and a collar. The collar has a helical thread and is welded to the annular lip. The canister body is closed by a lid having a plate portion and depending rim portion with the depending rim portion having a helical thread for threadably engaging the thread of the collar to retain the lid on the canister body. An annular gasket is disposed in the lid for sealing with the rolled edge defining the mouth of the container and an HEPA filter assembly is integral with the lid.

In a more specific aspect, the canister is made of stainless steel and is useful for containing radioactive materials such as plutonium powders.

In still another more specific aspect, the canister cooperates with other similar canisters of different capacities and sizes to nest therewith.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
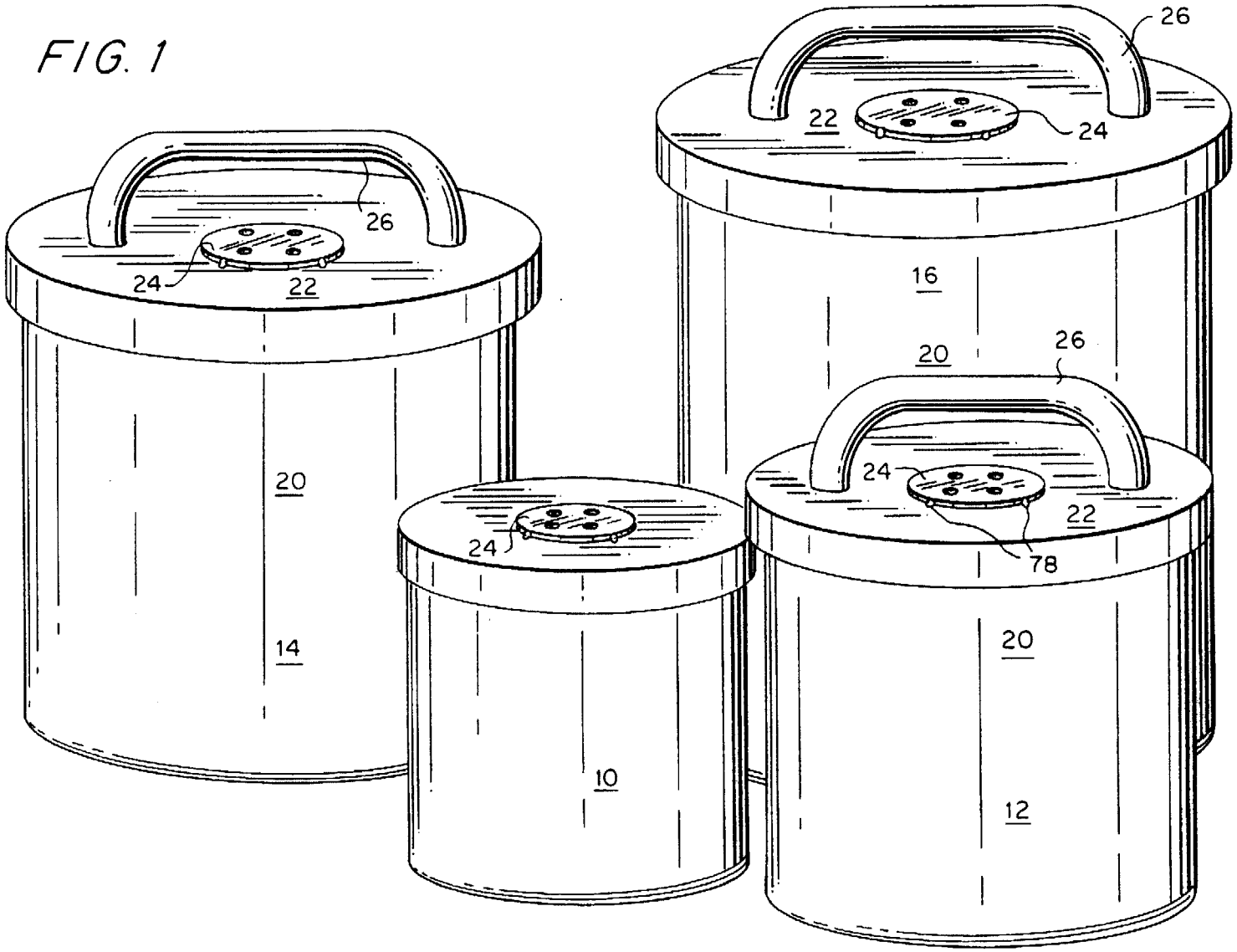
FIG. 1 is a perspective view showing several canisters of different sizes for storage of hazardous materials such as plutonium powders.
Figure 2:
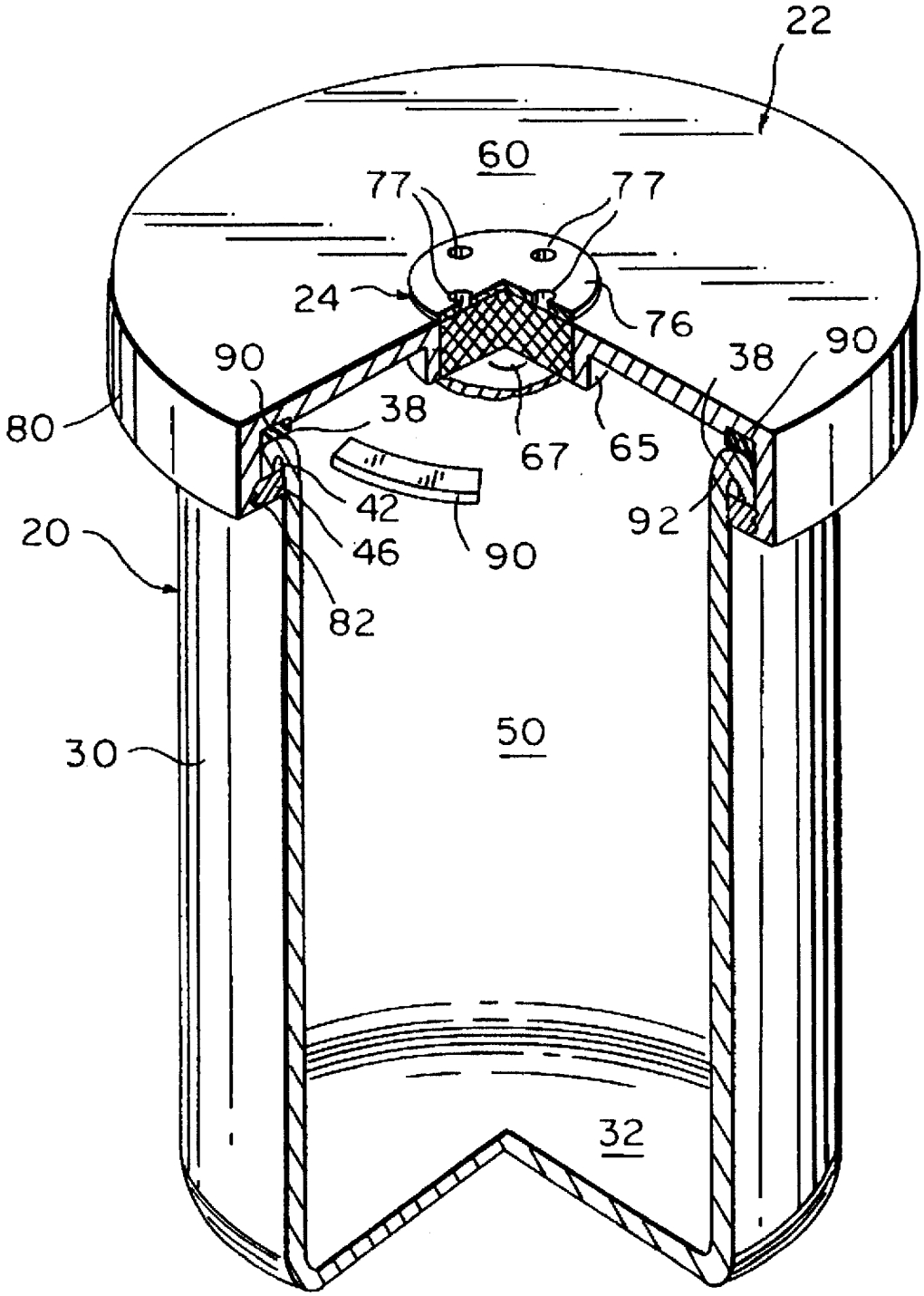
FIG. 2 is a side perspective view, partially in elevation, illustrating one of the canisters of FIG. 1, the other canisters having substantially the same configuration.

Referring now to FIG. 1, there are shown four canisters 10, 12, 14 and 16, especially useful for storage of plutonium powders in the form of plutonium oxides and salts. Generally, the canisters 10–16 are opened only within glove boxes (not shown) for filling or emptying. While storage of plutonium powders is of special significance, the canisters may be used for storing other materials, especially hazardous materials such as other nuclear waste materials. Preferably, the canisters 10, 12, 14 and 16 are assembled in a nested relationship for storage with the canister 10 within the canister 12, the canister 12 within the canister 14 and the canister 14 within the canister 16. Preferable sizes for the canisters 10–16 are one quart for the canister 10, three quarts for the canister 12, eight quarts for the canister 14 and twenty-four quarts for the canister 16.

With the exception of their size, the canisters 10–14 have substantially the same configuration wherein each canister includes a canister body 20, a lid 22, an HEPA filter assembly 24 integral with the lid, and a handle 26 unitary with the lid. Since the one quart canister 10 is relatively small, it does not necessarily have a handle 26. This is because it is convenient to have each of the handles 26 the same size and because a handle readily grippable would be too large for the one quart canister 10 and not permit nesting of the one quart canister 10 within the three quart canister 12. It is noted that each of the integral HEPA grade filters 24 are also of the same size and configuration, regardless of the capacity of the canisters 10–14 with which they are used.

Referring now to FIG. 2–5 where details of one of the canisters 10, 12, 14 or 16 are shown, it is seen that the canister body 20 is comprised of a side wall 30, which is joined to a flat bottom 32 via a radius corner 34. The body has a wide mouth 36 defined by a rolled edge 38 with a downwardly extending lip 40 having a downwardly facing annular edge 41. The annular edge has an inside diameter greater than the diameter of the cylindrical side wall 30 to define a gap 42 therebetween.

The canister body 20 is extruded from 20 gauge 304-L stainless steel. The interior surface of side wall 30 is highly polished to a surface finish smoother than a #32 finish, so that even the finest powder grains of the powdered plutonium salts or oxides stored in the interior space 50 of the container will not adhere to the inside surface of wall of the canister body 20.

Figure 3:
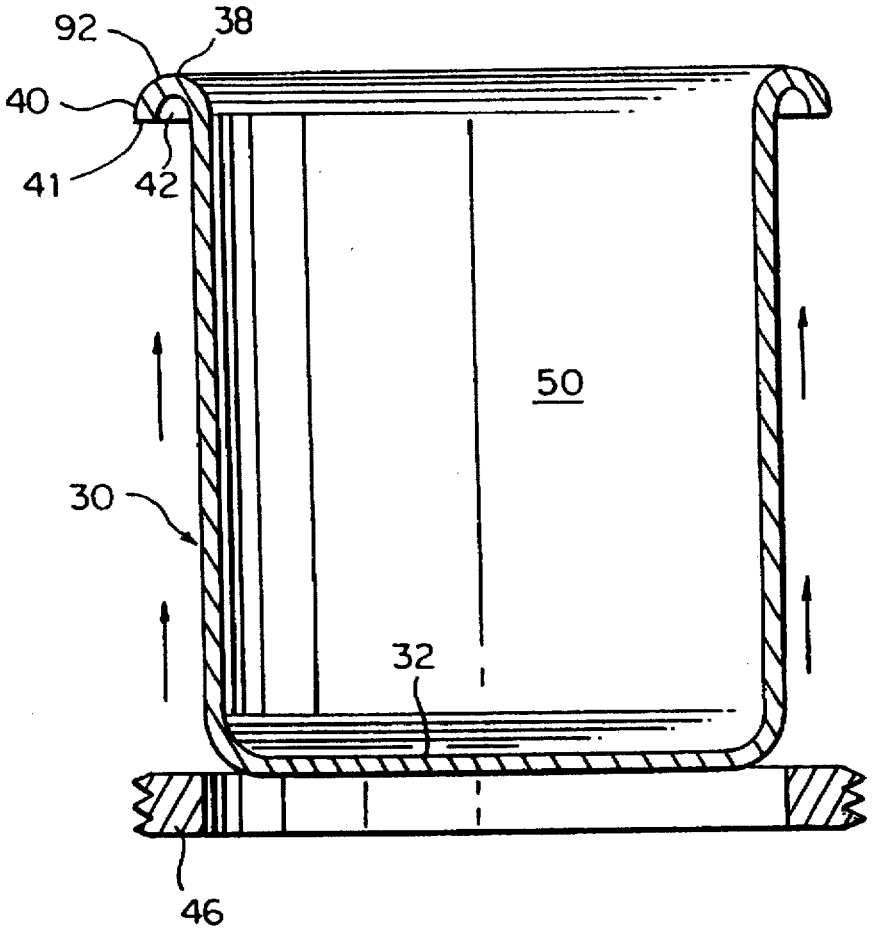
FIG. 3 is a side elevation illustrating how an externally threaded collar is mounted on a body portion of one of the canisters.
Figure 4:
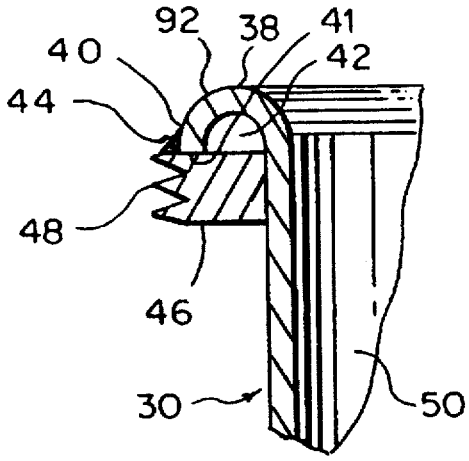
FIG. 4 is a side elevation showing a mouth portion of the canister with the collar of FIG. 3 welded thereto.
Figure 5:
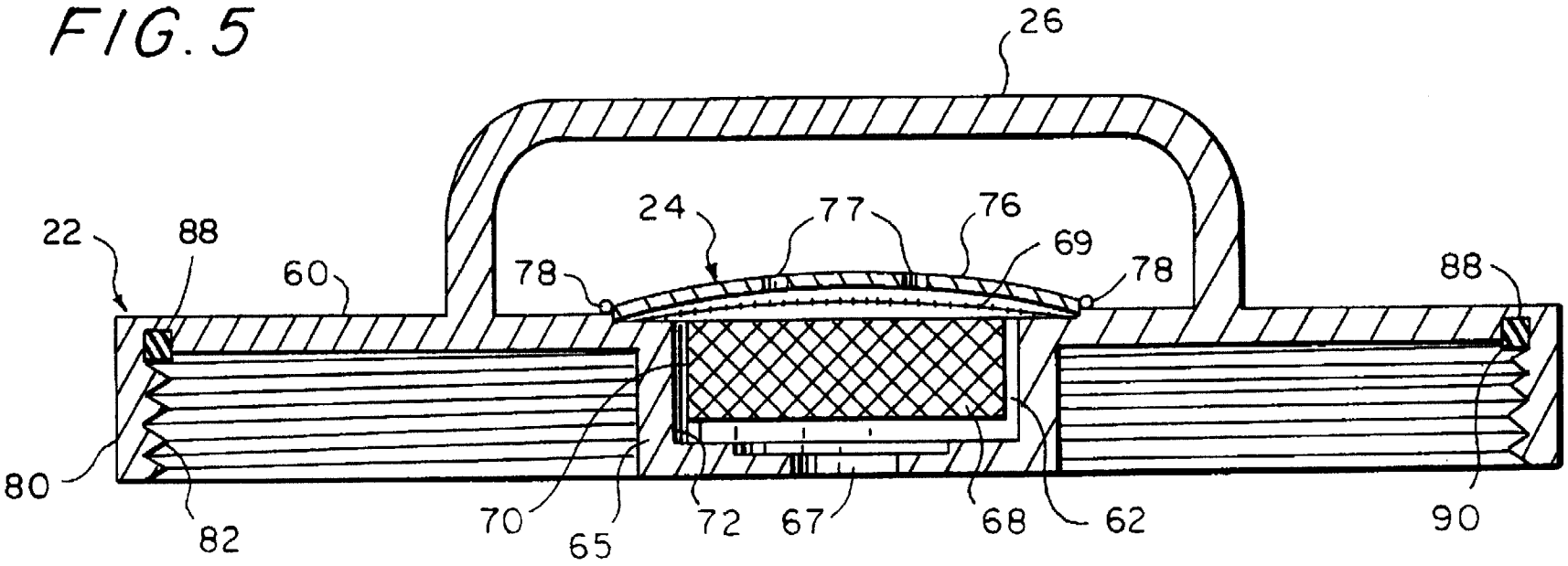
FIG. 5 is a side elevation showing a lid for the canister with a filter assembly integrated therewith.

The canister body 20 has thereon an externally threaded steel collar 46 which is welded to the annular edge 41 of the lip 40 and provides an external helical thread 48 onto which the cap 22 is threaded. As is seen in FIG. 3, the stainless steel collar 46 is mounted on the canister body 20 by heating the collar to expand its diameter and then sliding the collar up over the canister body into abutment with the annular edge 41 of the lip 40. As is seen in FIG. 4, the collar 46 is welded to the annular edge 41 to form a continuous TIG welded seam 44. The seam 44 is the only seam on the canister body 30 and it is located external to the interior space 50 containing the powders so as to prevent corrosion or degradation of the seam by the powders.

The mouth 36 of each canister 20 is closed by a lid 22 having an integral HEPA filter assembly 24 for venting the canister. Each lid 22 includes a round lid plate 60 with a round, central cavity 62 in which the filter assembly 24 is positioned so as to be integral with the lid. The cavity 62 is defined by a cylindrical wall 65 which is unitary with the lid plate 60 and an annular bottom 66 which has an opening 67 therethrough which communicates with the interior space 50 of the canister body 20. The filter assembly 24 comprises a filter block in the form of a disk filter 68 made of carbon-carbon or sintered stainless steel and a GORTEX® membrane 69. If the disk filter 68 is made of carbon-carbon, it is adhered by adhesive disposed between the cylindrical periphery 70 thereof and the cylindrical wall surface 72 of the cavity. If the filter disk 68 is of sintered stainless steel, the cylindrical periphery 70 thereof is welded to the cylindrical wall surface 72 of the cavity 62. The GORTEX® membrane 69 has a diameter slightly greater than the diameter of the cavity 62 and is laid across the disk filter 68 and adhered to a shelf portion 74 in the plate 60 which surrounds the cavity 62. A perforated cap 76 having vent holes 77 therein is placed over the GORTEX® member 69 and spot welded to the plate 60 at the periphery of the annular shelf 74 by four spot wells 78. The filter disk 68 blocks solid particles while the Gortex® sheet 69 blocks flow of liquid either into or out of the canister while allowing the flow of vapor or gases in both directions. The canisters 10–16 are therefor vented to the atmosphere while retaining hazardous solids and liquids and while preventing entry into the containers of liquids which might contaminate and render more dangerous the plutonium powders in the containers.

Unitary with the lid plate 60 is an internally threaded rim 80 which has internal threads 82 which mesh with the external threads 48 on the collar 46 which is welded to lip 40 of the canister body 20 at the seam 44. The lid plate 60 has an annular groove 88 therein at the juncture of the rim 80 and lid plate, which groove extends over the interface of the threads 48 and 82. The groove 88 receives an annular gasket 90 which is substantially rectangular in cross-section. The preferable material for the gasket 90 is Viton®. As the lid 22 is tightened down, an arcuate portion 92 of the rolled edge 38 abuts the material of the gasket 90 to seal the lid with respect to canister body 20. The Viton® gasket 90 is radiation resistant, is made of 30 durometer neoprene and is preferably cemented in the groove 88. Preferably, the lid 22 is thicker than a canister body 30 and is made of 12 gauge 304-L stainless steel.

The canisters 10, 12, 14 and 16, configured in accordance with the structures of FIGS. 2–5, will hold internal pressures of up to about 120 psi with no leakage and, when half full of sand, can withstand about a 9 ft. drop, without rupturing. By utilizing the GORTEX® membrane 69 in the filter 24, water entry of up to 56 inches of water column pressure, is prevented. All of the interior surfaces of the canisters 10, 12, 14 and 16 are seamless, the only welded seam being the continuous seam 44 on the exterior of the canister where the threaded neck 46 is welded to the lip 40.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A canister for containing hazardous material, the canister comprising:

a seamless canister body of a first thickness, the canister body having a mouth defined by a rolled edge with a depending annular lip;

a collar having second thickness greater than the first thickness and being welded to the annular lip, the collar having an external helical thread formed therein;

a lid having a plate portion and a depending rim portion, the depending rim portion having internal threads for threadably engaging the threads of the collar for retaining the lid on the canister body;

an annular gasket disposed on the lid for sealing with the rolled edge defining the mouth of the container; and a filter assembly integral with the lid.

2. The canister of claim 1 further including a cavity in the lid having an opening therein communicating with the interior of the canister body and, the filter assembly comprising a block of filter material seated within the housing.

3. The canister of claim 2 further including a cap with perforations therein overlying the block filter material and being affixed to the lid.

4. The canister of claim 3, wherein the filter further comprises a GORTEX® sheet between the cap and block of filter material.

5. The canister of claim 4, wherein the block of filter material is a carbon-carbon block or a block of sintered stainless steel.

6. The canister of claim 5, wherein the canister body is made of stainless steel and the canister lid is made of stainless steel.

7. The canister of claim 1, wherein the canister body and lid are made of stainless steel.

8. The canister of claim 7, wherein a handle is integral with the lid for carrying the canister.

9. A canister for storing hazardous material, such as powdered uranium oxides and salts, the canister comprising:

an extruded, seamless canister body of stainless steel, the canister body having a wide mouth surrounded by an annular lip;

a stainless steel collar having a thickness greater than that of the canister by being welded to the annular lip, the collar having a helical thread formed thereon;

a stainless steel lid having a plate portion and a depending rim portion, the depending rim portion having threads for threadably engaging the threads of the collar for retaining the lid on the canister body;

an annular gasket disposed on the lid for sealing with the mouth of the container; and an HEPA filter assembly integral with the lid.

10. The canister of claim 1 further including a cavity in the lid having an opening therein communicating with the interior of the canister body, the HEPA filter assembly comprising a block of filter material seated within the cavity.

11. The canister of claim 2 further including a cap with perforations therein overlying the block of filter material being affixed to the lid.

12. The canister of claim 11, wherein the filter assembly further comprises a GORTEX® sheet disposed between the perforated cap and the block of filter material.

13. The canister of claim 12, wherein the block of filter material is a carbon-carbon block or a block of sintered stainless steel.

14. The canister of claim 9, wherein a handle is integral with the lid for carrying the canister.

15. A plurality of canisters for storing hazardous material, such as radioactive materials, each canister comprising:

an extruded, seamless canister body of stainless steel, the canister body having a wide mouth surrounded by an annular lip;

a stainless steel collar having a thickness greater than that of the canister and being welded to the annular lip, the collar having a helical thread formed therein;

a stainless steel lid having a plate portion and a depending rim portion, the depending rim portion having threads for threadably engaging the threads of the collar for retaining the lid on the canister body;

an annular gasket disposed on the lid for sealing with the mouth of the container; and an HEPA filter assembly integral with the lid; wherein each canister is of a different capacity and of dimensions that it nests with the other canisters, the smaller canisters all fitting within the largest canister.

16. The canisters of claim 15 each further including a cavity in the lid of thereof, the cavity having an opening therein communicating with the interior of the canister body, the HEPA filter assembly of each canister comprising a block of filter material seated within the cavity.

17. The canisters of claim 16 each further including a cap with perforations therein overlying the block of filter material with each cap being affixed to each of the lids.

18. The canisters of claim 17, wherein the filter assembly of each canister further comprises a GORTEX® sheet disposed between the perforated cap and block of filter material of each canister.

19. The canisters of claim 18, wherein the block of filter material in the cavity of each canister is a carbon-carbon block or a block of sintered stainless steel.

20. The canisters of claim 15, wherein at least some of the canisters have handles affixed to the lids thereof.

* * * * *